US006299116B1

(12) United States Patent
Levesque

(10) Patent No.: US 6,299,116 B1
(45) Date of Patent: Oct. 9, 2001

(54) CIRCULAR FLOWERPOT SUPPORT

(76) Inventor: Micheline Levesque, 215 Grande Allee, Terrebonne, Quebec (CA), J6W 4S2

( * ) Notice: Subject to any disclaimer, the term of this patent is extended or adjusted under 35 U.S.C. 154(b) by 0 days.

(21) Appl. No.: 09/413,364

(22) Filed: Oct. 6, 1999

Related U.S. Application Data

(63) Continuation-in-part of application No. 09/048,101, filed on Mar. 26, 1998, now abandoned.
(60) Provisional application No. 60/041,214, filed on Mar. 27, 1997.

(51) Int. Cl.[7] ..... A47K 1/08
(52) U.S. Cl. ..... 248/312.1; 248/231.41; 248/311.2
(58) Field of Search ..... 248/315, 312.1, 248/311.2, 314, 231.71, 228.6, 213.2; 47/40, 39, 68

(56) References Cited

U.S. PATENT DOCUMENTS

| | | | | |
|---|---|---|---|---|
| 451,715 | * | 5/1891 | Rockhill | 248/231.41 |
| 756,723 | * | 4/1904 | Skoog | 223/107 |
| 1,006,994 | * | 10/1911 | Barnes | 248/231.71 |
| 1,207,916 | * | 12/1916 | Hendricks | 248/231.71 |
| 1,313,803 | * | 8/1919 | Dunn | 248/210 |
| 1,339,491 | * | 5/1920 | Axberg | 248/311.2 |
| 1,474,323 | * | 11/1923 | Geibel | 248/214 |
| 1,962,556 | * | 6/1934 | Eberhardt, Jr. | 206/562 |
| 3,194,403 | * | 7/1965 | Van Horn, Jr. | 211/78 |
| 3,991,961 | * | 11/1976 | Platzer, Jr. | 248/99 |
| 4,428,151 | * | 1/1984 | Solomon | 47/81 |
| 5,058,787 | * | 10/1991 | Chou | 224/556 |
| 5,118,059 | * | 6/1992 | Mainer | 248/215 |
| 5,169,108 | * | 12/1992 | Carlson | 248/311.2 |
| 5,193,304 | * | 3/1993 | Krueger | 47/67 |
| 5,220,744 | * | 6/1993 | Kendall | 47/39 |
| 5,279,072 | * | 1/1994 | Garbo | 47/41.14 |
| 5,395,080 | * | 3/1995 | Smith | 248/215 |
| 5,649,386 | * | 7/1997 | Rynbertk | 47/41.14 |
| 5,667,180 | * | 9/1997 | Duckworth | 248/311.2 |
| 5,860,630 | * | 1/1999 | Wildey et al. | 24/311.2 |

* cited by examiner

*Primary Examiner*—Anita King
(74) *Attorney, Agent, or Firm*—Eric Fincham

(57) ABSTRACT

A hanger for a plant container wherein the hanger has a mounting section comprised of a front wall, rear wall and top wall defining a downwardly open U-shaped channel to receive a horizontal member with a pair of screws being screw threadably engaged with the front wall and extending towards the back wall. A flexible plate member is secured to a distal end of each of the screws whereby tightening of the screws causes the flexible plate member to move towards the back wall and narrow the channel. A ring shaped member having a generally circular aperture is designed to support a plant container, an inwardly facing wall surrounding the aperture having a plurality of inwardly extending protrusions on the surface thereof.

6 Claims, 2 Drawing Sheets

CIRCULAR FLOWERPOT SUPPORT

The present application is a continuation-in-part of application serial number 09/048,101 filed Mar. 26, 1998 now abandoned and claims benefit of Prov. No. 60/041,214 filed Mar. 27, 1997.

BACKGROUND OF THE INVENTION

The present invention relates to a hanger for a plant container and more particularly, to a hanger which is suitable for mounting on a horizontal member.

Gardening is one of the most widely practiced leisure activities and as such, there have been many proposals in the art for various types of hangers for plant containers. Such hangers have been designed for use in virtually any environment such as railings, eaves troughs, walls, and for suspending from different objects. The present invention is particularly concerned with a hanger for a plant container and which hanger is adapted to use with a horizontal member such as is found on a deck railing or a patio railing.

Such railing hangers are popular since typically, the railings exist for one purpose or another in most urban and rural environments. The type of railings may vary from a typical metallic railing about patios in many urban environments to fence or wood type railings in the more rural locations.

The known railing hangers engage the upper edge of the railing and usually extend downwardly either on the interior or exterior of the railing to support the plant container. While such hangers have been widely used, they do suffer from several disadvantages.

Firstly, the method of attaching the hanger to the railing must be adaptable to receive different size railings. Furthermore, not all railings are uniform and accordingly, if the attachment of the hanger to the railing does not take this into account, problems can arise and even safety concerns can exist when the hanger is located at a substantial height such as is the case with balcony railings in high rise buildings.

Furthermore, the hanger should be designed to provide sufficient space between the railing and plant. Still further, the hanger should be preferably adaptable for different types of containers and designed to securely hold the containers therein.

SUMMARY OF THE INVENTION

It is an object of the present invention to provide a hanger for a plant container wherein the hanger is adaptable for attachment to many different sizes and configurations of railings.

It is a further object of the present invention to provide a hanger for a plant container wherein the hanger may be made as a one-piece molded unit of a plastic material.

It is a further object of the present invention to provide a hanger wherein the plant container is securely retained therein.

According to one aspect of the present invention, there is provided, in combination, a plant container and a hanger, the hanger comprising first means for retaining the hanger on a generally horizontal member; second means for retaining the plant container; the first means comprising a front wall, a rear wall, and a top wall extending between the front wall and the rear wall to thereby define a downwardly open U-shaped channel, a pair of screws being screw threadably engaged with the front wall and extending therethrough towards the back wall, a flexible plate member secured to a distal end of each of the screws, the arrangement being such that tightening of the screws causes the flexible plate member to move towards the back wall and thereby narrow the channel; the second means comprising a section extending outwardly from the front wall, a generally circular aperture formed in the outwardly extending section, an inwardly facing wall surrounding the aperture, the inwardly facing wall having a plurality of protrusions on the surface thereof, each of the protrusions having a protrusion top wall located downwardly from a top marginal edge of the inwardly facing wall, and an arcuate convex side wall extending downwardly from the protrusion top wall, the container having a side wall sized to at least partially fit within the generally circular aperture formed in the outwardly extending section.

In greater detail, each of the protrusions extending from the inwardly facing wall surrounding the aperture preferably has a top wall which is located downwardly from a top marginal edge of the inwardly facing wall and also has an arcuate convex side wall extending downwardly from the top wall.

In one embodiment, each of the protrusion side walls of the arcuate convex configuration tapers inwardly and downwardly such that a bottom portion thereof has a thickness less than the top portion thereof.

In one embodiment, the front wall, rear wall and top wall which define the downwardly open U-shaped channel each has a plurality of reinforcing ribs running in a general vertical direction, the ribs being located on the wall surfaces defining the channel. The reinforcing ribs on the front wall terminate short of a bottom peripheral edge to thereby provide room for the flexible plate member.

The screws which are screw threadably engaged with the front wall preferably comprise thumb screws formed of a plastic material. Furthermore, the screws are preferably press fittingly engaged with an aperture in the flexible plate member.

The hanger may also, in one embodiment of the present invention, be adaptable to use as a support surface/tabletop.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
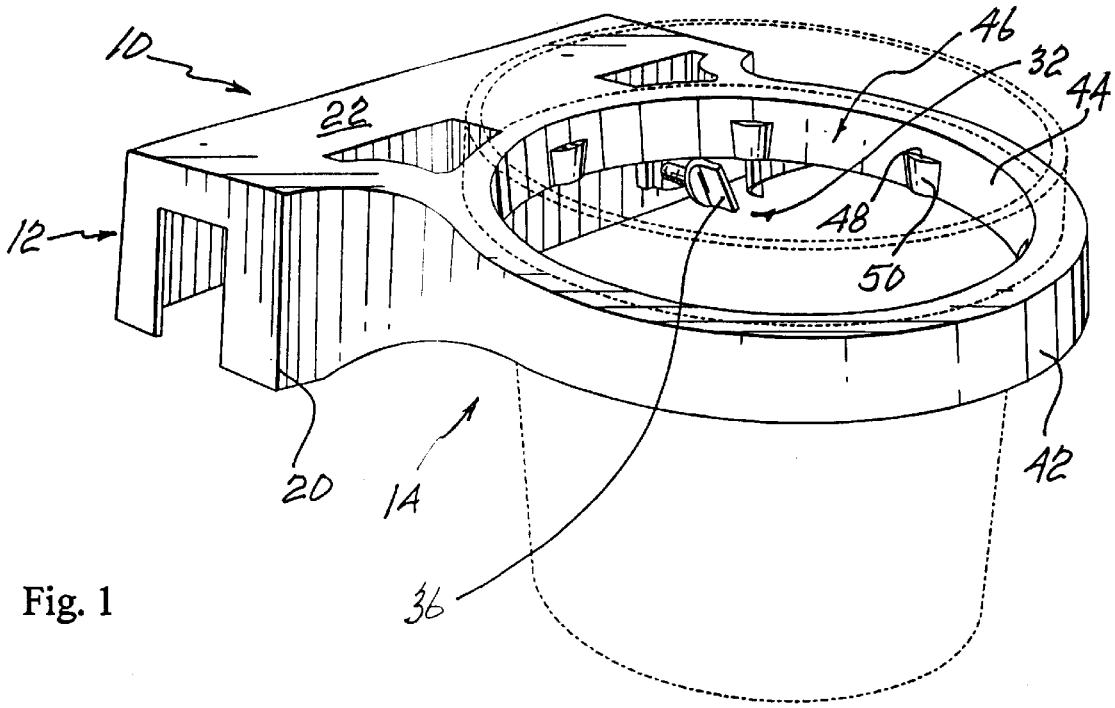
FIG. 1 is a perspective view of a hanger for a plant container according to the present invention.
Figure 2:
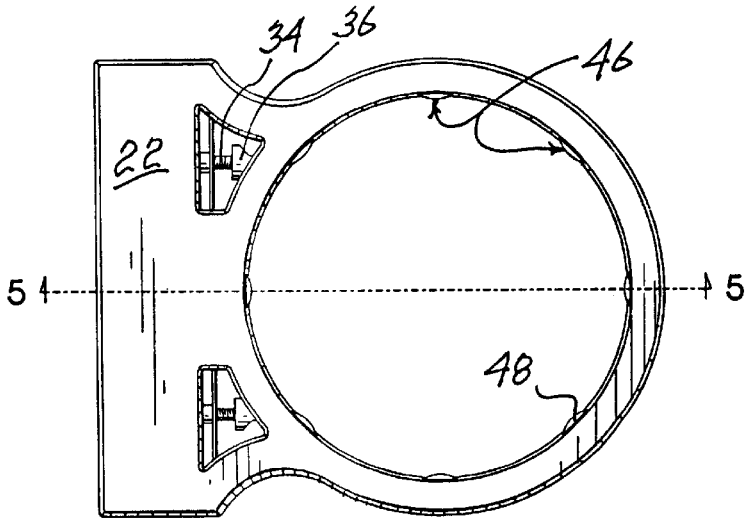
FIG. 2 is a top plan view thereof.
Figure 3:
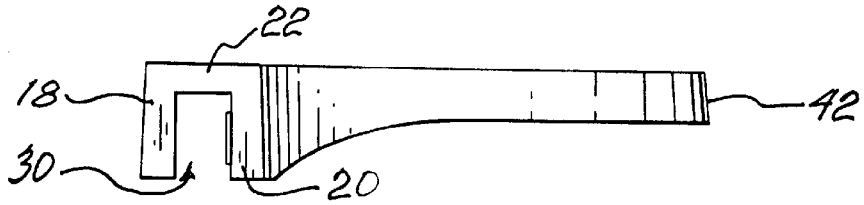
FIG. 3 is a side elevational view thereof.
Figure 4:
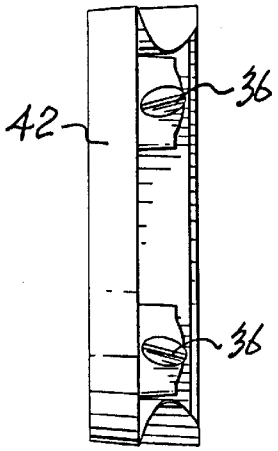
FIG. 4 is a front elevational view thereof as seen from the right hand side of FIG. 2.

Referring to the drawings in greater detail and by reference characters thereto, there is illustrated a hanger which is suitable for a plant container and which hanger is generally designated by reference numeral 10 and is preferably of a molded plastic material.

Hanger 10 has a mounting section 12 for mounting the hanger 10 on a suitable horizontal member and a container retaining section generally designated by reference numeral 14.

Mounting section 12 has a back wall 18, a front wall 20 and a top wall 22 extending between back wall 18 and front wall 20. Defined between back wall 18, front wall 20 and top wall 22 is a downwardly open U-shaped channel 30. In the illustrated embodiment, back wall 18 includes back wall reinforcing ribs 24 and similarly, there are provided front wall reinforcing ribs 28 and top wall reinforcing ribs 26 with reinforcing ribs 26 terminating short of the bottom peripheral edge to provide room for a flexible plate member as discussed below.

Extending through front wall 20 are a pair of plastic screws generally designated by reference numeral 32. Each screw 32 includes a shaft portion 34 which is screw threadably engaged with front wall 20 and a thumb head 36. Mounted on the distal end of screws 32 is a flexible plate member 38. Each screw preferably terminates in a circular section which is press fittingly engaged in an aperture formed in flexible plate 38.

Container retaining section 14 includes a ring shaped member 42 and which has an inner wall 44 surrounding an aperture therein. On inner wall 44 there are provided a plurality of protrusions 46. Each protrusion has a top wall 48 which is spaced downwardly from a top marginal edge of inner wall 44. A side wall 50 has a generally arcuate convex configuration with the side wall tapering inwardly and downwardly as it extends to the bottom peripheral edge of inner wall 44.

Figure 5:
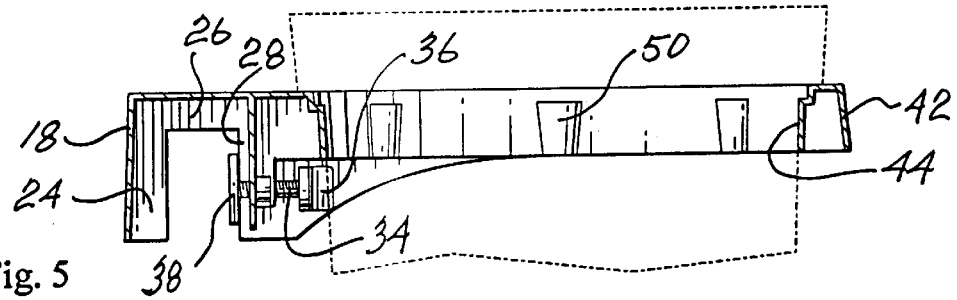
FIG. 5 is a sectional view taken along the line 5—5 of FIG. 2.

Hanger 10 is designed to receive a plant container such as is shown in dotted lines in FIGS. 1 and 5. In this respect, the plant container may either seat on the upper wall of ring member 42 or on top wall 48 of protrusions 46.

In attaching hanger 10 to a suitable horizontal member, the hanger 10 is placed such that U-shaped channel 30 receives the horizontal member. Screws 32 may be tightened and the arrangement with the provision of a flexible plate member 38 allows for inconsistencies in the thickness or configuration of the horizontal member.

Figure 6:
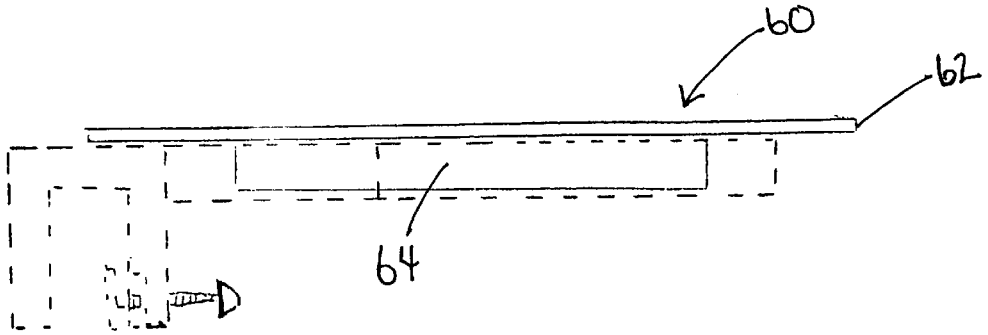
FIG. 6 is a side elevational view showing the use of a support surface in conjunction with the hanger, the hanger being shown in dotted lines.

As shown in FIG. 6, there may be provided a support member generally designated by reference numeral 60. Support member 60 includes an upper disc shaped support surface 62 with a lower annular flange 64 depending therefrom. Annular flange 64 is sized to engage protrusions 46.

It will be understood that the above described embodiments are for purposes of illustration only and that changes and modifications may be made thereto without departing from the spirit and scope of the invention.

I claim:

1. In combination, a plant container and a hanger, said hanger comprising:

first means for retaining said hanger on a generally horizontal member;

second means for retaining said plant container;

said first means comprising a front wall, a rear wall, and a top wall extending between said front wall and said rear wall to thereby define a downwardly open U-shaped channel, a pair of screws being screw threadably engaged with said front wall and extending therethrough towards said rear wall, a flexible plate member secured to a distal end of each of said screws whereby tightening of said screws causes said flexible plate member to move towards said rear wall and thereby narrow said channel;

said second means comprising a section extending outwardly from said front wall, a generally circular aperture formed in said outwardly extending section, an inwardly facing wall surrounding said aperture, said inwardly facing wall having a plurality of protrusions on the surface thereof, each of said protrusions having a protrusion top wall located downwardly from a top marginal edge of said inwardly facing wall, and an arcuate convex side wall extending downwardly from said protrusion top wall, said arcuate convex side wall tapering inwardly and downwardly to a bottom peripheral edge of said inwardly facing wall, said container having a side wall sized to at least partially fit within said generally circular aperture formed in said outwardly extending section.

2. The combination of claim 1 wherein each of said front wall, rear wall and top wall defining said downwardly open U-shaped channel has a plurality of reinforcing ribs on wall surfaces defining said channel, said reinforcing ribs on said front wall terminating short of a bottom peripheral edge thereof to provide room for said flexible plate member.

3. The combination of claim 1 wherein each of said screws screw threadably engaged with said front wall comprises thumb screws formed of a plastic material.

4. The combination of claim 1 wherein each of said protrusion side walls tapers inwardly and downwardly from said protrusion top wall towards said inwardly facing wall.

5. The combination of claim 1 wherein said hanger is formed of a molded plastic material.

6. The combination of claim 1 wherein a distal end of each of said screws is press fittingly engaged with an aperture in said flexible plate member.

* * * * *